US005441305A

United States Patent [19]

Tabar

[11] Patent Number: 5,441,305

[45] Date of Patent: Aug. 15, 1995

[54] APPARATUS AND METHOD FOR POWERED THERMAL FRICTION ADJUSTMENT

[76] Inventor: William J. Tabar, 1403 Quail Meadows Dr., Park City, Utah 84060

[21] Appl. No.: 93,056

[22] Filed: Jul. 16, 1993

[51] Int. Cl.[6] ..... A63C 11/00

[52] U.S. Cl. ..... 280/809; 219/211; 219/527; 280/610

[58] Field of Search ..... 219/211, 527; 280/11.12, 816, 809, 601, 610

[56] References Cited

U.S. PATENT DOCUMENTS

| | | | |
|---|---|---|---|
| 3,119,921 | 1/1964 | Czaja | 280/816 X |
| 3,343,495 | 9/1967 | Petrik | 280/11.12 X |
| 3,774,923 | 11/1973 | Suroff | 280/11.13 |
| 3,866,927 | 2/1975 | Tvengsberg | 280/11.12 |
| 4,837,494 | 6/1989 | Maier | 322/1 |
| 4,864,860 | 9/1989 | Manseth | 73/490 |
| 5,169,169 | 12/1992 | Crawford | 280/601 |

*Primary Examiner*—Brian L. Johnson

*Assistant Examiner*—Michael Mar

*Attorney, Agent, or Firm*—Madson & Metcalf

[57] ABSTRACT

An apparatus and method for adjusting the friction between a slide such as a ski and a responsive material such as snow by heating or cooling a portion of the material to change the material's coefficient of friction is disclosed. The apparatus includes a slide, a power source, and a thermal means which uses power from the power source to heat or cool the material the slide glides over. Electrical and chemical power sources are described. In one presently preferred embodiment, the slide is a ski, the power source includes electric batteries, and the thermal means includes heating elements embedded in the ski. The amount and location of heat produced may be controlled manually, remotely, or automatically. The batteries may be enclosed in the ski or attached to the skier's back. Other presently preferred embodiments include heated ice skate blades, snowmobile runners, and sled runners. Thermal means which heat the snow directly rather than heating the slide first are also disclosed.

16 Claims, 8 Drawing Sheets

APPARATUS AND METHOD FOR POWERED THERMAL FRICTION ADJUSTMENT

FIELD OF THE INVENTION

The present invention relates to an apparatus and method for adjusting the frictional engagement of a slide with a responsive material by adjusting the temperature of a portion of the material near the slide. More particularly, the invention relates to reducing the friction between a ski and snow by heating a portion of the snow.

TECHNICAL BACKGROUND OF THE INVENTION

Familiar examples of slides include skis, snowmobile runners, and ice skate blades. However, slides take other forms as well. Even though skis are used extensively herein as examples, it should be understood that much of this discussion applies to other slides as well.

Slides are widely used to assist many types of travel. Such travel may be recreational, as with much alpine and cross-country skiing. Sleds and other slides also provide the best mode of commercial travel in many locations. In addition, slides may prove essential to search and rescue personnel facing emergencies in cold climates.

A slide is typically long and narrow, with a flat running surface, a leading tip, and an upward curve near the leading tip. The running surface may be several inches wide, as with skis, or very narrow, as with ice skates. The upwardly curved portion of the slide is known as the shovel; as used herein, "upward" means away from the snow or other material the slide glides over. Slides range in length from a few inches to many feet. They may be formed of wood, metal, plastic, composite, and other substances. They may be constructed by many methods, such as casting, heat treatment, lamination, and adhesion.

Like many slides, a ski operates by gliding on its running surface over snow or ice. The snow preferably makes initial contact with the ski near the back of the ski's shovel so that the upturned portion of the running surface does not slow the ski by plowing into the snow. Most or all of the running surface is typically in contact with the snow in order to distribute weight to prevent the skier from sinking into the snow.

Skis may be cambered to more evenly distribute their load over the snow. If an unloaded cambered ski is laid on a hard flat floor, only the front and rear of the ski's running surface contact the floor. However, if the cambered ski is loaded with a skier's weight, the ski flattens out so that most or all of the running surface contacts the floor thereby distributing the load across substantially the entire ski. Similar weight distribution occurs as the loaded ski travels over snow and ice.

The speed at which the ski glides over the snow depends on the forces applied to the ski and on the friction between the ski and the snow. In cross-country skiing, friction between the ski and the snow is sometimes desirable, such as when a skier is traveling uphill. Friction may also help reduce speeds to levels that are safe for novice skiers. However, in alpine skiing and many other applications, it is often very desirable to minimize the amount of friction between the slide and the material beneath the slide. Reducing the friction increases the skier's gliding speed because effort that would have gone into overcoming friction is applied instead to moving the ski. Reducing the friction likewise reduces the effort required to ski at a given speed. In short, reducing the friction provides skiers with a range of beneficial choices including increased speed, reduced effort, and combinations thereof.

One known approach to reducing friction is to increase the slide's lubricity. One method of increasing lubricity is to construct the slide from relatively smooth substances. For instance, skis formed of bare metal are generally faster than those formed of bare wood because metal is generally smoother than wood. The running surface of commercially available skis is often formed of polyethylene, polypropylene, or a similar lubricous composition.

Another widely practiced method is to smooth and lubricate the ski's running surface by covering it with a layer of wax. The wax may be applied in several ways. The simplest approach is to rub the wax into the running surface by hand before using the ski. Alternatively, the wax may be melted onto the running surface and then pressed into the surface with a hot iron. Both of these methods have the major drawback that skiing rubs the wax off, so repeated waxing is necessary. In addition, different waxes are optimal for different snow conditions and temperatures. Thus, changes in temperature may make rewaxing desirable even before the previously placed wax wears away.

A related prior approach pumps liquid wax through conduits onto the running surface while the skier skis. However, this approach also has several drawbacks. The wax conduits may break or clog. The wax is not always distributed uniformly over the running surface. The skier must carry a pump which may be bulky, expensive, or vulnerable to extremes of temperature and vibration. The skier must also carry a significant reservoir of appropriate wax; being a liquid, the wax wears away more rapidly than solid waxes. And finally, the skier must continually monitor the rewaxing process.

Another prior approach to reducing friction is to vibrate the ski at ultrasonic frequencies. A major drawback of this approach is the difficulty of manufacturing reliable and economical vibrating skis. In addition, users may be discomforted by the noise or vibrations produced. Vibrating skis may also tend to diminish skier control and may dig into relatively soft snow that conventional skis would rest on or glide over.

Thus, it would be an advancement in the art to provide an apparatus and method for adjusting the friction between a slide and material the slide glides over.

For instance, it would be an advancement to provide an apparatus and method for adjusting the friction between a ski and snow in order to match the frictional drag with skill levels and other conditions.

It would also be an advancement to provide an apparatus and method for reducing the friction between a ski and snow without requiring substantial and repeated intervention from the skier.

It would be a related advancement to provide such an apparatus and method which does not require the repeated application of wax to the ski.

It would also be an advancement to provide a reliable apparatus and method with which skiers may adjust friction between the ski and snow while skiing.

It would be a further advancement in the art to provide an apparatus and method which enhances gliding by reducing friction between the ski and a wide variety of snowy materials.

Such an apparatus and method is disclosed and claimed herein.

BRIEF SUMMARY OF THE INVENTION

The present invention includes an apparatus and method for adjusting frictional engagement of a slide with a responsive material. The apparatus includes a slide, a power source, and a thermal means. In operation, the power source powers the thermal means, which adjusts the friction between the slide and the responsive material by heating or cooling a portion of the responsive material.

As used herein, a responsive material is a material that may respond to changes in temperature with significant changes in its coefficient of friction. Changes in the coefficient of friction need not be directly proportional to changes in temperature. The apparatus is independent from and does not include either the responsive material or the driving means (gravity, tractor treads, muscles, etc.) which drives the slide over that material.

The apparatus and method may be used for either increasing or decreasing friction. This change in friction may be achieved by cooling or heating the responsive material. However, without in any way limiting the scope of the present invention, discussion herein focuses on presently preferred embodiments which heat a responsive material in order to reduce friction. In particular, the discussion focuses on heating "snow." As used herein, the term "snow" includes not only pure snow but also ice, slush, frost, frozen mud, mixtures of these materials, and any other material that may become slippery when heated.

The slide may be a ski, a runner on a snowmobile or sled, an ice skate blade, part of an aircraft's landing gear, a snowboard, or a similar structure. Thus, the slide is typically long and narrow, with an upwardly curved shovel near a leading tip. The slide includes a body connected to a base. The body provides structural strength, as well as a mounting location for struts, stanchions, ski boot bindings, and other attachments. The base has a running surface which frictionally engages the snow while the slide is in use.

The power source may be directly attached to the slide, embedded within the slide, or disposed near the slide. In one presently preferred embodiment, for instance, electric batteries are embedded within a ski, while another embodiment includes a battery pack carried by a skier. The power may be provided by electrical, chemical, or other manufactured means. For instance, electric batteries, solar power cells, internal combustion engines, and exothermic chemical reactions may all be employed in accordance with the teachings of the present invention.

The thermal means utilizes power from the power source to heat a portion of the responsive material. The thermal means may heat the responsive material directly, or it may heat the slide's running surface, which in turn heats the responsive material. In a presently preferred embodiment, for instance, a flat printed circuit heating element, which is embedded in a ski, heats the ski's running surface, which then heats the snow. The heating element preferably does not heat the ski to a temperature which weakens adhesives or other bonds.

Within the ski, the heat need not be evenly distributed along the running surface. In one presently preferred embodiment the heating element directs heat mainly toward the edges of the ski. The edges are typically excellent thermal conductors, and they often contribute heavily to energy loss through friction. Thus, reducing friction by heating the edges is both effective and efficient. In addition, the heating element lies near a heat reflector which reflects heat away from the ski's body back toward the snow.

The flow of power from the power source to the thermal means may be controlled by the user to thereby control both the heat's intensity and its location. Different sections of the ski, such as the forward and rear portions, or the running surface and the adjoining edges, may be heated differently. The apparatus may also include a temperature sensor which senses the temperature of the running surface and an automatic controller which is in signal communication with both the temperature sensor and the power source. The automatic controller responds to signals from the temperature sensor by controlling the flow of power in order to increase or decrease the heat produced.

These and other features of the present invention will become more fully apparent through the following description and appended claims taken in conjunction with the accompanying drawing.

BRIEF DESCRIPTION OF THE DRAWINGS

In order that the manner in which the above-recited and other advantages of the invention are obtained, a more particular description of the invention summarized above will be rendered by reference to the appended drawings. Understanding that these drawings only provide data concerning typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

The present invention includes an apparatus and method for adjusting frictional engagement of a ski or other slide with a responsive material such as snow. The apparatus includes a slide, a power source, and a thermal means. These three elements will be illustrated generally by reference to various embodiments of the invention before those embodiments are described in detail.

Figure 1:
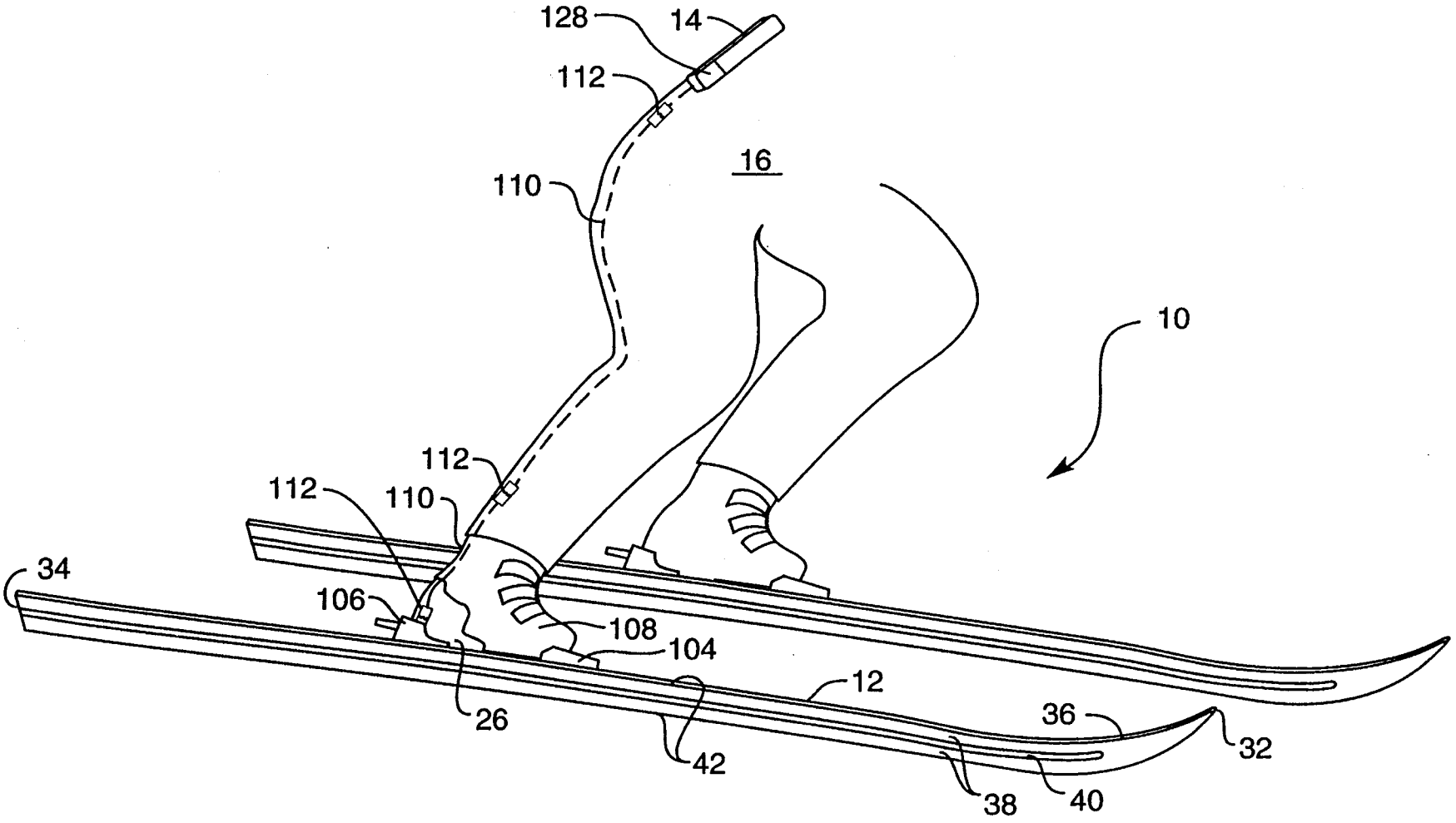
FIG. 1 is a perspective view of the invention in a presently preferred embodiment illustrating a heated ski that is powered by a power source attachable to a skier.

Referring now to the figures wherein like parts are referred to by like numerals, one preferred embodiment of the present invention, depicted in FIG. 1, is generally designated 10. This embodiment includes a slide in the form of a ski 12, a power source in the form of a battery pack 14 worn by the skier 16, and a thermal means that includes heating elements 18, 20 (see FIGS. 3, 4, and 5) disposed inside the ski 12.

The power source is preferably of a size that permits it to travel with the slide. Thus, in the embodiment shown in FIG. 1, the battery pack 14 is attachable to the skier. Likewise, in the alternative embodiment illustrated in FIG. 2, batteries 22 are enclosed in a ski 24.

Although FIG. 1 shows an electric battery pack 14, the power source may also involve other electrical, chemical, or manufactured means. For instance, solar power cells or another electrical generation means could be attached to the skier 16 or the ski 12. Chemical means such as an exothermic reaction or combustion of gasoline could also be used. The amount of power required to significantly decrease the friction between a slide and the snow depends on the snow's temperature and composition, the slide's running surface temperature, the efficiency of the thermal means, and the desired change in the snow's coefficient of friction. However, power requirements may be determined by those of skill in the art without undue experimentation once a particular application such as alpine skiing is targeted.

Figure 8:
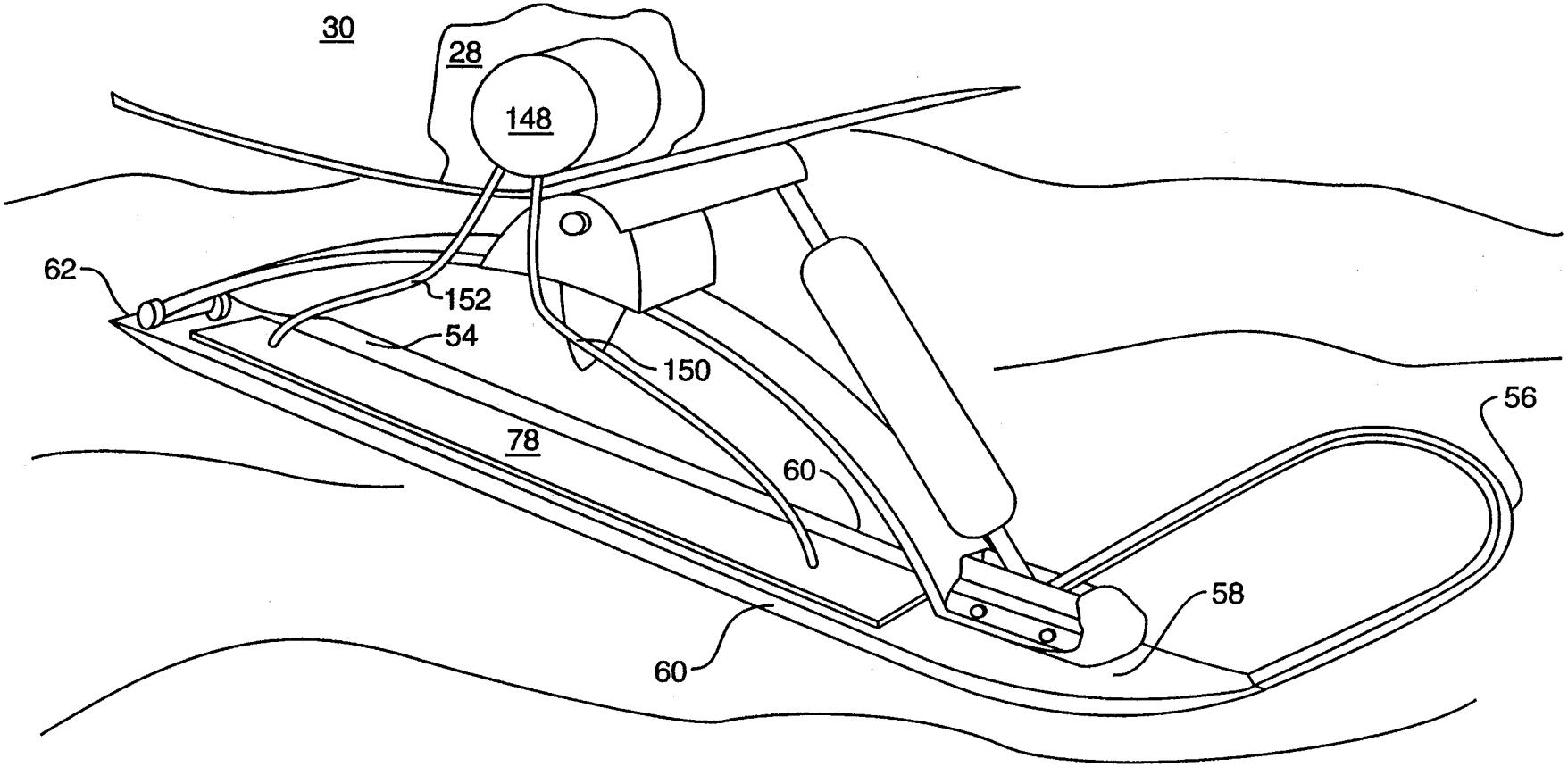
FIG. 8 is a partial cut-away perspective view of an alternative embodiment of the present invention utilizing a heat exchanger along a runner of a motorized vehicle such as a snowmobile.

In addition to providing power for heating the responsive material, the power source of the present invention may also have other effects. For instance, heating the ski 12 shown in FIG. 1 may also beneficially heat the skier's foot 26. Likewise, FIG. 8 illustrates an alternative embodiment of the invention in which the power source is a motor 28 that also drives a vehicle 30 forward over the snow. As far as the present invention is concerned, however, these effects are incidental to the main purpose of the power source, which is to heat the snow in order to reduce friction.

Figure 5:
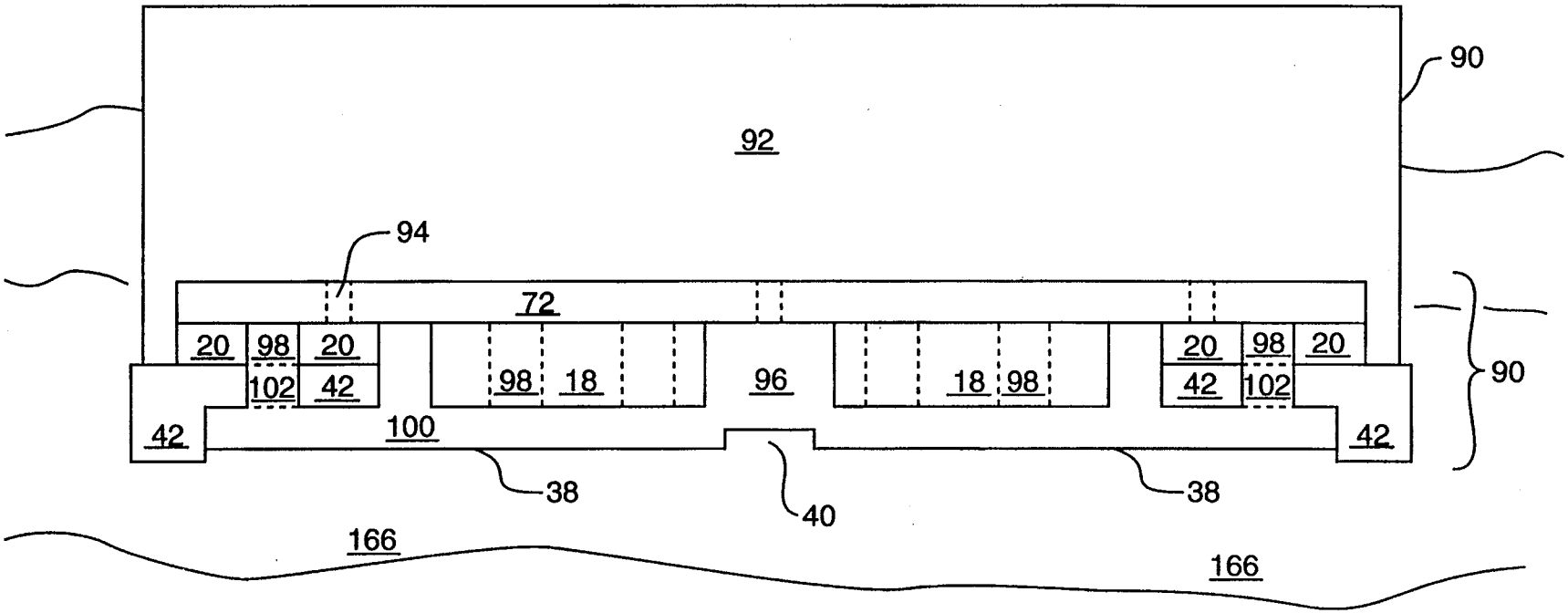
FIG. 5 is cross-sectional view taken along line 5—5 of FIG. 4, further illustrating the presently preferred heated ski embodiment shown in FIGS. 1, 3, and 4.

The ski 12 illustrated in FIG. 1 is in many respects a typical embodiment of the slide. The ski 12 has an upturned leading tip 32 at one end and a tail 34 at the opposite end. A curved portion of the ski 12, known as the shovel 36, adjoins the leading tip 32. A running surface 38 lies along the bottom of the ski 12 from the leading tip 32 down the shovel 36 to the tail 34 of the ski 12. As best shown in FIGS. 1 and 5, the running surface 38 contains a groove 40 for most of its length. The running surface 38 is located between two substantially parallel longitudinal edges 42.

Figure 6:
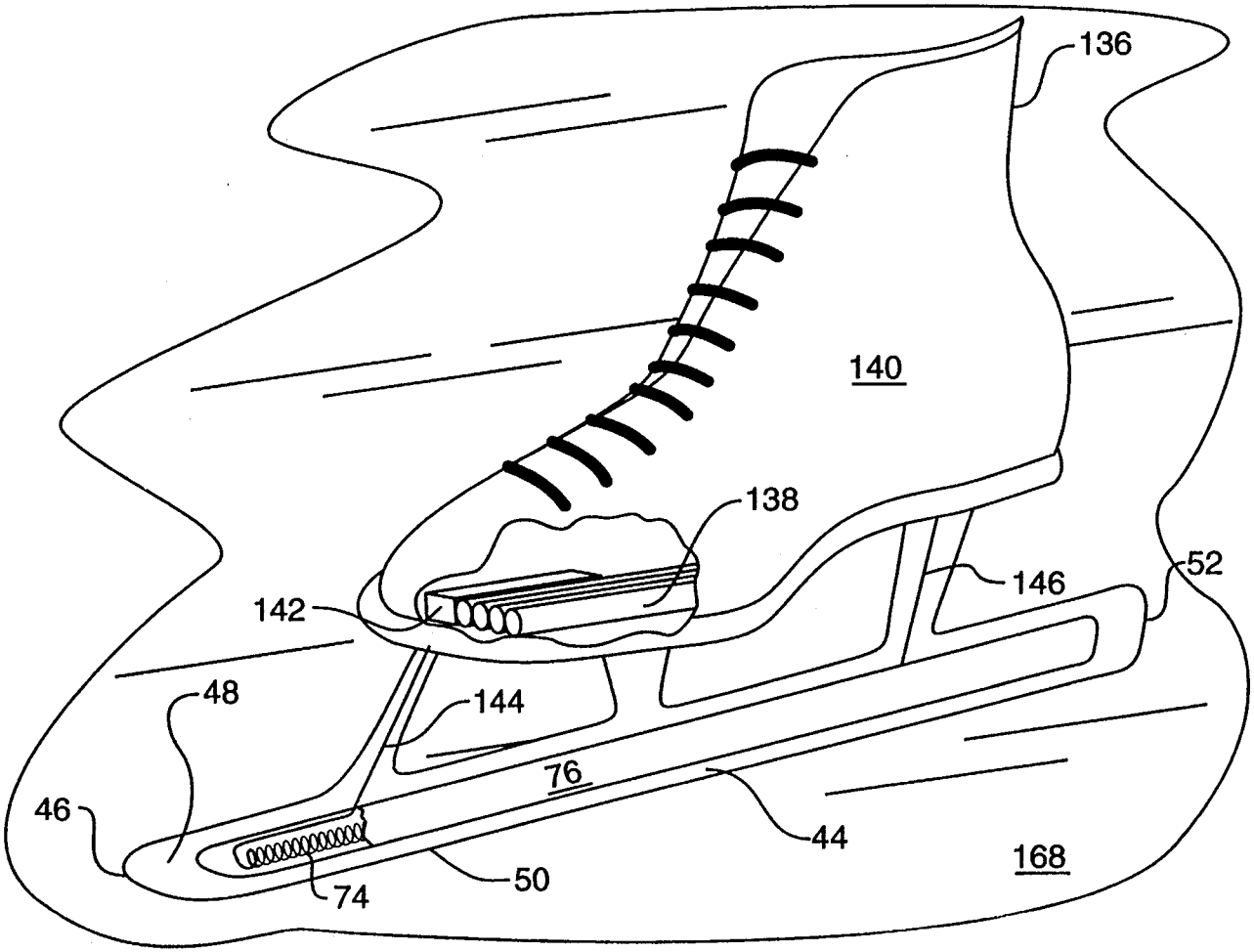
FIG. 6 is a partial cut-away perspective view of an alternative embodiment of the invention in a heated ice skate.
Figure 9:
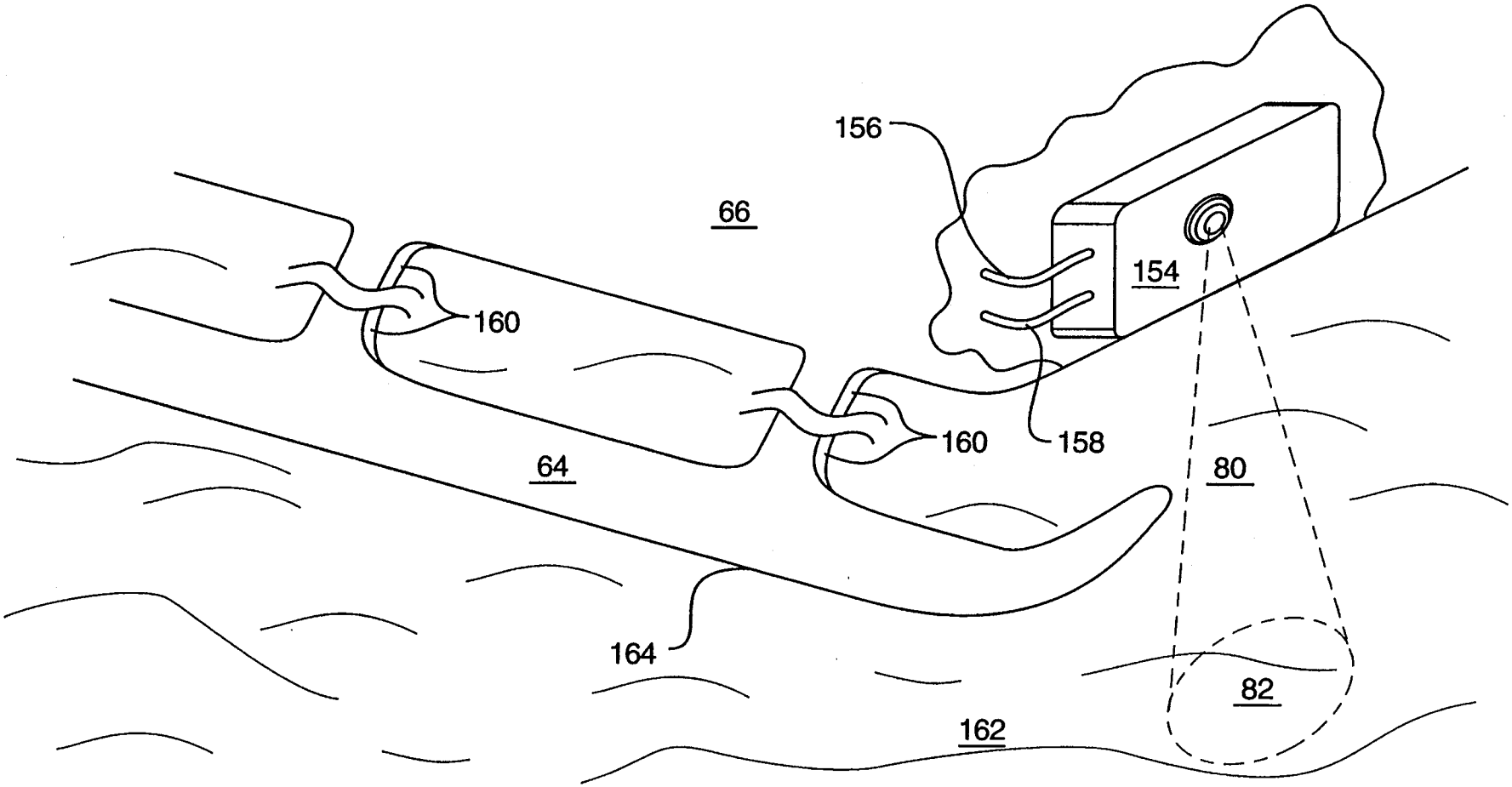
FIG. 9 is a partial cut-away perspective view of an alternative embodiment of the present invention utilizing an electromagnetic beam emitter located on a sleigh.

As shown in FIGS. 6, 8, and 9, other slides are typically shaped much like skis. FIG. 6 shows an ice skate blade 44 having a leading tip 46, a shovel 48, a running surface which is essentially a single longitudinal edge 50, and a tail 52. FIG. 8 illustrates a snowmobile or other vehicle 30 with a runner 54 having a leading tip 56, a shovel 58, a running surface (not shown) located between two longitudinal edges 60, and a tail 62. FIG. 9 shows a similar runner 64 on a sled 66. However, variations on slide geometries also lie within the scope of the present invention. For example, the slide may be substantially square, may lack a shovel, may be cambered, or may be wrapped about an axle in cylindrical fashion.

Figure 2:
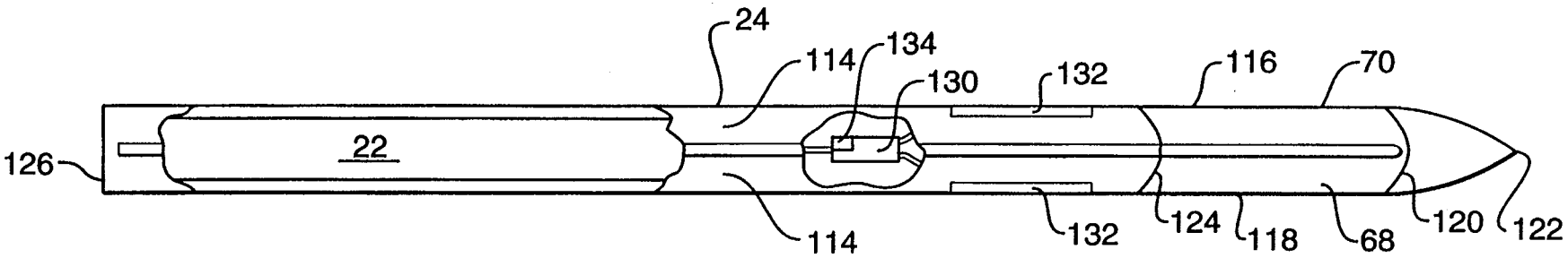
FIG. 2 is partial cut-away bottom view of an alternative embodiment of the present invention in a ski, illustrating batteries inside the ski, a programmed automatic controller in communication with temperature sensors, and a curved heating plate located near the ski's shovel.
Figure 3:
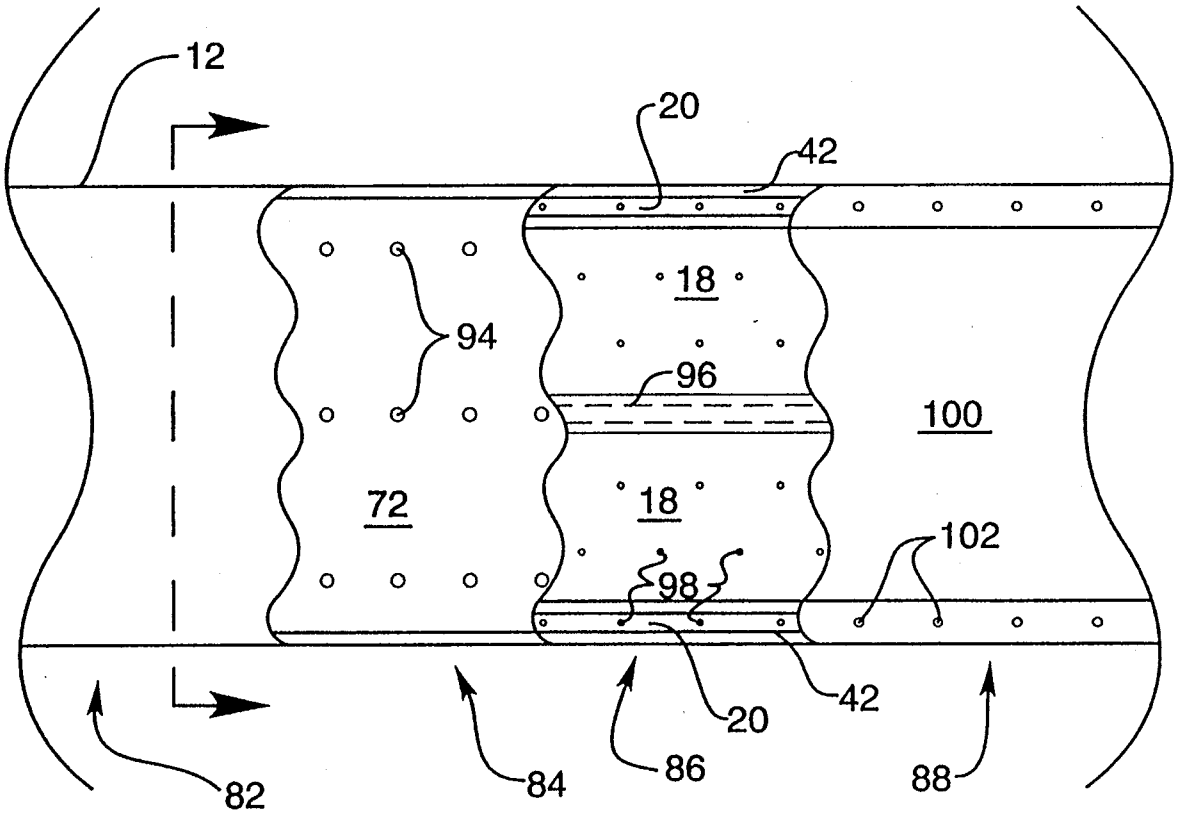
FIG. 3 is a top view taken about line 3—3 of FIG. 1, illustrating several layers within the ski by successive partial cut-aways.
Figure 4:
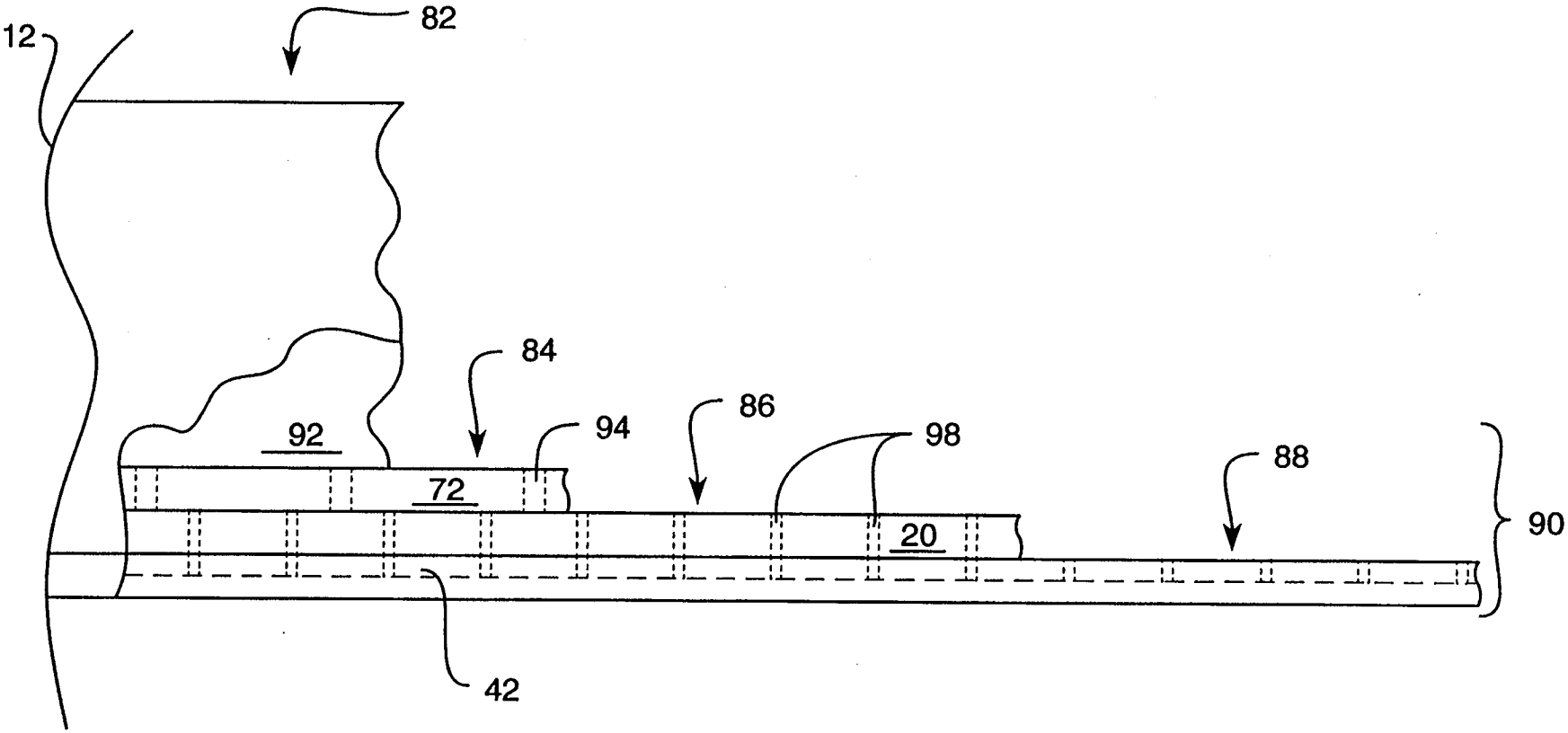
FIG. 4 is a side view taken along line 4—4 of FIG. 3, further illustrating layers of the ski, including the ski's bottom or running surface, heating elements, a heat reflector, and the body of the ski.

The appended drawings also illustrate several embodiments of the thermal means of the present invention. FIG. 2 shows a thermal element in the form of a curved heating plate 68 located adjacent to a shovel 70 portion of the ski 24. FIGS. 3 through 5 illustrate several printed circuit heating elements 18, 20 in thermal communication with the longitudinal edges 42 and running surface 38 of the ski 12; a heat reflector 72 is also part of this thermal means. FIG. 6 illustrates an electrically resistant wire 74 embedded in a ceramic case 76, which is in turn mounted in thermal communication with the metal ice skate blade 44. FIG. 8 shows a heat exchanger 78 capable of transferring heat from a circulated fluid (not shown) to an adjacent runner 54. Finally, FIG. 9 shows an emitted beam 80 which heats the snow 82 directly rather than heating the runner 64 first. Those of skill in the art will appreciate that other thermal means also lie within the scope of the present invention.

Turning now to the detailed structure of particular preferred embodiments, it will be seen that FIGS. 3 through 5 illustrate one possible configuration of heating elements within the ski 12 first depicted in FIG. 1. In particular, FIGS. 3 and 4 each illustrate four layers of the ski through partial cut-aways, while FIG. 5 illustrates these same layers in a cross-sectional view.

As illustrated in FIGS. 3 and 4, the ski 12 has a topmost layer, generally designated at 82. Three bottom layers, generally designated at 84, 86, and 88 in FIG. 4, form the base 90 of the ski 12. A body 92 of the ski 12 adjoins the base 90. The body 92 may be formed of wood, fiberglass, plastic, graphite, or other substances, as is done in conventional skis. A box, chambered, laminated, solid or other construction may be used, as with conventional skis.

As shown in FIGS. 3 and 4, the layer 84 contains a heat reflector 72. The heat reflector 72 contains perforations 94 to permit mechanical connection between the heat reflector 72 and the body 92 of the ski 12. Connection is achieved by filling the perforations 94 with small integral extensions of the body 92. Epoxies or other securing means could also be employed to secure the heat reflector 72, provided that they perform adequately while heated and do not fail after repeated heating/cooling cycles.

The layer 86 contains several heating elements 18, 20. The heating elements 18, 20 may include printed circuit heating elements such as those presently manufactured for use in heating ski boots. Two heating elements 18 are disposed near the running surface 38, with a gap 96 between the two heating elements 18 that corresponds to the groove 40 in the running surface 38. Two additional heating elements 20 are disposed near the longitudinal edges 42 of the ski 12. As shown in FIGS. 1 and 3, the heating elements 18, 20 are electrically connectable to the battery pack 14, from which they receive the power used to heat the ski 12. The heating elements 18, 20 have perforations 98 to permit their attachment to the running surface 38 and the longitudinal edges 42. Small integral extensions of the running surface 38 and the longitudinal edges 42 may protrude into the perforations 98, thereby securing the heating elements 18, 20 in place. Other adequate securing methods could also be employed.

The heating elements 18, 20 shown are merely illustrative and in no way limiting of the invention. Other heating methods also lie within the scope of the present invention. Moreover, the heating elements may be arranged in different patterns within the ski, or may be partially exposed, as is the curved heating plate shown in FIG. 2. The heating elements may also be arranged into heating sections for heating different portions of the ski 12 differently. For instance, the heating sections may permit heating of a leading portion of the ski 12 separately from a trailing portion. Or the heating sections may permit heating of the ski's longitudinal edges 42 separately from the ski's running surface 38.

As shown in FIGS. 3 and 4, the bottommost layer 88 contains a structure 100 whose bottom side shapes the running surface 38. This structure 100 may include polypropylene, polyethylene, or a similar composition, as is conventional. The longitudinal edges 42 of the ski 12 are also visible in the layer 88. The edges 42 contain perforations 102 for attaching the edges 42 to the structure 100, but other adequate means could also be used. As shown in FIGS. 3 through 5, these longitudinal edges 42 may be composed of a different substance than the running surface 38. For instance, the edges 42 are commonly made of a metallic alloy rather than the polypropylene that commonly forms the running surface 38. Alternatively, the longitudinal edges 42 may simply be the edges of the structure 100 that forms the running surface 38.

As shown in FIG. 1, bindings 104, 106 are attached to the ski 12 to hold the skier's boot 108 in releasable engagement with the ski 12. A front binding 104 and a rear binding 106 hold the ski boot 108 securely on the ski 12 while the skier 16 is standing or skiing. To avoid injury to the skier 16, however, the bindings 104, 106 are designed to release the boot 108 if the skier 16 falls. For similar reasons, a wire 110 connecting the battery pack 14 to the heating elements 18, 20 (see FIG. 3) includes releasable connections 112 of conventional type. In addition, the wire 110 preferably connects to the ski 12 in or near the rear ski boot binding 106, to minimize the wire's impact on the skier's maneuverability.

FIG. 2 illustrates several features of the present invention in one alternative embodiment. Although these features are illustrated together in a single embodiment, different features may be combined in many different ways in other embodiments. The embodiment shown in FIG. 2 differs from the embodiment illustrated in FIGS. 1, 3, 4, and 5 in two major respects. First, the batteries 22 are disposed within the body of the ski 24 rather than in a pack 14 wearable by the skier 16. Consequently, the batteries 22 are preferably lightweight. The batteries 22 are also preferably aligned in a manner that enhances rather than retards the skier's maneuverability. For instance, the batteries 22 may be disposed symmetrically with respect to the ski's center of gravity.

A second difference between the embodiment shown in FIG. 2 and the embodiment in FIG. 1 is that the thermal means in FIG. 2 includes a curved heating plate 68 forming a portion of the running surface 114 along the shovel 70. The first embodiment, by contrast, employs heating elements 18, 20 disposed within the ski 12 as shown in FIGS. 3, 4, and 5. To reduce friction arising from gaps between the heating plate 68 and the running surface 114, the heating plate 68 preferably extends from one longitudinal edge 116 of the ski to the other 118. For similar reasons, the leading lip 120 of the heating plate 68 is preferably near the leading tip 122 of the ski 24 and the trailing lip 124 of the heating plate 68 is preferably between the trailing portion of the shovel 70 and the tail 126 of the ski 24. In this manner, friction may be reduced because snow generally first contacts the ski 24 between the plate's leading lip 120 and trailing lip 124 rather than at one of those lips.

FIGS. 1 and 2 also illustrate two of the many ways in which a controller may be used to regulate the thermal means of the present invention. The controller 128 of FIG. 1 is electrically connected to the battery pack 14 in order to regulate the flow of power to the heating elements 18, 20 (see FIGS. 3 through 5) and hence the amount and location of the heat produced. The controller 128 is manually directed by the skier 16.

In one presently preferred embodiment, the controller 128 is of the simple on-off variety. In an alternative preferred embodiment, the controller 128 provides additional control over the amount of power provided. Control over the amount of power in turn provides control over the amount of heat produced, thereby giving skiers a range of temperature adjustment capabilities. In additional preferred embodiments, the controller 128 also provides control over the flow of power to each of a set of heating sections placed at different locations about the ski. To permit manipulation of the controller 128 while the skier is skiing, alternative embodiments also include a remote control mechanism (not shown), which is attachable to the skier's pole, wrist, or waist.

The controller 130 shown in FIG. 2 illustrates one preferred embodiment of the controller in the form of a programmed automatic controller 130. The programmed automatic controller 130 is in signal communication with temperature sensors 132 placed near or in the ski's running surface 114. In response to signals from the temperature sensors 132, which indicate the temperature near the interface between the ski 24 and the snow, the programmed automatic controller 130 regulates the flow of power from the batteries 22 to the heating element 68.

In a presently preferred embodiment, the automatic controller 130 includes a computer microprocessor 134 which is programmed to adjust the power flow by increasing power to the heating element 68 when the sensed temperature is below a predetermined threshold and by decreasing power to the heating element 68 when the sensed temperature is above the predetermined threshold. If the amount of heat produced is a function of some electrical communication other than the power provided to the heating element, the controller may also be configured to monitor and control that communication.

The programmed automatic controller may, of course, receive signals from the skier as well as from the temperature sensors 132. In addition to turning the programmed automatic controller 130 on and off, the skier may indicate a desired level of friction, an expected length of time the apparatus will be in use, or other information useful to the programmed automatic controller 130 in efficiently utilizing the available power.

Although FIGS. 1 through 5 illustrate the present invention embodied in a ski, other embodiments also lie within the invention's scope. Three such alternative embodiments are illustrated in FIGS. 6 through 9.

Figure 7:
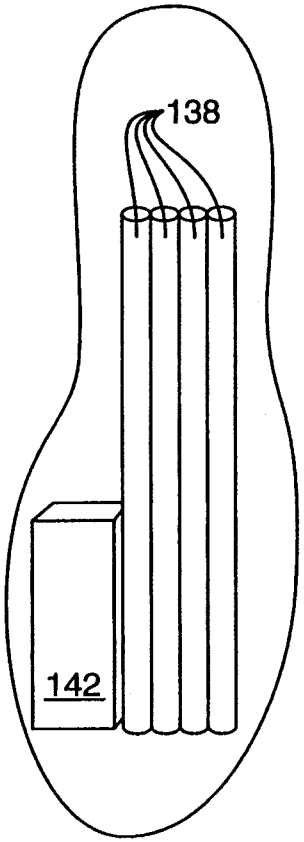
FIG. 7 is a partial cut-away top view of the embodiment shown in FIG. 6.

FIGS. 6 and 7 illustrate an embodiment of the present invention in an ice skate 136. The slide takes the form of an ice skate blade 44, the power source includes electric batteries 138 disposed inside a boot 140, and the heating element includes a wire 74 whose high electrical resistance converts electric power from the batteries 138 into heat. The batteries 138 may be nickel-cadmium or any other suitable type. The flow of electricity from the batteries 138 is preferably regulated by an electrically and physically adjacent controller 142. The electricity flows from the batteries 138 through a first wire 144 into the heating element 74, out a second wire 146, and back to the batteries 138 to complete the circuit.

FIG. 8 illustrates an embodiment of the invention wherein the slide is a runner 54 on a snowmobile or other vehicle 30 powered by a motor 28. A pump 148 mounted inside the vehicle 30 is in fluid communication with the motor's coolant system (not shown). A first conduit 150 leads from the pump 148 to one end of a heat exchanger 78. A second conduit 152 connects the opposite end of the heat exchanger 78 to the pump 148. The heat exchanger 78 is mounted on or in the runner 54 near the running surface (not shown).

FIG. 9 illustrates another embodiment of the present invention, which differs from previously described embodiments in that it is configured to heat the snow directly rather than heating the slide and then transferring heat from the slide to the snow. In this embodiment, an emitter 154 capable of emitting a beam 80 of electromagnetic radiation is mounted on a vehicle 66. The vehicle 66 may or may not be motorized. Control lines 156 and power lines 158 connect the emitter 154 to a power source (not shown) and a controller (not shown). The emitted radiation 80 may include laser beams, infrared beams, microwave radiation, or other forms of energy. A runner 64, which is connected to the vehicle 66 by stanchions 160, engages the snow 162 at an interface 164. The emitter 154 is oriented to direct the emitted beam 80 at a region 82 directly in front of the interface 164.

In operation, these various embodiments all apply the method of the present invention. Initially, the slide frictionally engages the responsive material along an interface. The interface is that portion of the responsive material which contacts the slide when the slide is in use. For example, the ski 12 in FIG. 5 engages snow 166 beneath the ski's running surface 38. Similarly, the ice skate blade 44 in FIG. 6 engages the ice 168 along the blade's edge 50.

The engagement between the slide and the responsive material is frictional in that the surface of the slide and the surface of the responsive material each have a coefficient of friction. Thus, the ski 12 shown in FIGS. 1 and 5 offers resistance to the snow 166, and the snow 166 likewise offers resistance to the ski 12. Previous approaches have sought to reduce the total friction between ski and snow by decreasing the friction offered by the ski. Indeed, a major purpose of ski wax is to reduce the ski's coefficient of friction.

By contrast, the present invention operates principally on the responsive material rather than the slide. In FIGS. 3 through 5, for instance, the heating elements 18, 20 are located within the ski 12 and so heat the ski 12 during operation, but their principal purpose is to heat the snow 166. Heating the ski 12 is merely one approach to heating the snow 166. FIG. 9 illustrates another approach which does not require a heated slide.

In operating those embodiments of the invention which heat the snow indirectly by heating the slide first, care must be taken that the slide is not damaged. For instance, the heating elements 18, 20 shown in FIGS. 3 through 5 preferably do not heat the ski 12 up to a temperature which substantially weakens adhesives or other bonds. Overheating may cause damage either by virtue of the heat itself or by causing repeated extreme differences in temperature as the ski 12 is heated and cooled by use or storage. Consequently, in laminated skis containing heating elements, the internal ski temperature is preferably less than about 100 degrees Fahrenheit in order to reduce the risk of delamination.

Although the discussion herein focuses on heating snow, the teachings of the present invention are broader than that application. The present invention teaches an apparatus and method for adjusting the coefficient of friction of a responsive material by employing a thermal means to heat or cool a portion of the responsive material. The thermal means may include a thermal element such as a heating element, and may also include heat reflectors and other components. The present invention may be utilized to either decrease or increase friction between the slide and the responsive material.

In many situations, such as alpine skiing and bobsled racing, reduced friction is desirable because faster speeds are preferred. However, in other situations it may be desirable to increase friction between the slide and the responsive material. For instance, novice skiers may be safer gliding at slower speeds. Cross-country skiers may also prefer greater friction when ascending hills, even if they prefer less friction when descending.

Those of skill in the art will realize that the features described herein may be combined in ways not directly illustrated by the Figures. For instance, the scope of the present invention also includes a ski 12 utilizing heating elements 18, 20 like those in FIGS. 3 through 5 in conjunction with batteries 22 disposed inside the ski 24 as shown in FIG. 2. In addition, although discussion has focused on use of the present invention to adjust friction with snow, it will be appreciated that the teachings of the present invention also include use on asphalt and other responsive materials.

The present invention is capable of being embodied in a variety of ways, only a few of which have been illustrated and described above. The invention may be embodied in other forms without departing from its spirit or essential characteristics. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed and desired to be secured by patent is:

1. An apparatus for reducing friction with snow, comprising:

a ski comprising a body and a base secured to said body, at least a portion of said base configured to frictionally engage the snow;

a power source; and a heating element powerable by said power source and disposed near said base, said heating element having a plurality of perforations, said base having a plurality of integral extensions which extend into said perforations for securing said heating element to said base, said heating element being capable of heating at least a portion of said base to facilitate reducing the friction between said ski and the snow.

2. The apparatus of claim 1, wherein at least a portion of said heating element is disposed between said body and said base.

3. The apparatus of claim 2, further comprising a heat reflector disposed between said body and said heating element for distributing heat from said heating element to said base and away from said body.

4. The apparatus of claim 1, wherein said base comprises:

two substantially parallel longitudinal edges; and a running surface disposed between said longitudinal edges.

5. The apparatus of claim 4, wherein said heating element provides substantially different heat to said running surface than to said longitudinal edges.

6. The apparatus of claim 1, wherein said base comprises a leading tip and a shovel disposed near said leading tip, said shovel having a curved bottom such that initial contact between said apparatus and the snow routinely occurs along said bottom of said shovel said heating element comprising a curved heating plate disposed along said bottom of said shovel.

7. The apparatus of claim 1, further comprising a controller in signal communication with said heating element, for adjusting the amount of heat produced by said heating element.

8. The apparatus of claim 7, further comprising a temperature sensor capable of sensing the temperature of at least a portion of said ski, said temperature sensor being in signal communication with said controller for adjusting the amount of heat produced by said heating element in response to the temperature of said ski.

9. The apparatus of claim 8, wherein said controller is a programmed automatic controller, said programmed automatic controller programmed to signal said heating element to increase the amount of heat produced if said temperature sensor senses a temperature below a first predetermined threshold and to signal said heating element to decrease the amount of heat produced if said temperature sensor senses a temperature above a second predetermined threshold.

10. An apparatus for reducing friction with snow, comprising:

a ski comprising a body and a base secured to said body, at least a portion of said base configured to frictionally engage the snow, said base comprising two substantially parallel longitudinal edges and a running surface disposed between said longitudinal edges;

a power source; and a heating element powerable by said power source and disposed between said body and said base, said heating element being longitudinal members overlying said longitudinal edges and being in thermal communication therewith for heating at least one of said longitudinal edges separately from said running surface to facilitate reducing the friction between said ski and the snow.

11. The apparatus of claim 10, further comprising a heat reflector disposed between said body and said heating element for distributing heat from said heating element to said base rather than said body.

12. The apparatus of claim 10, wherein said heating element has a plurality of perforations and wherein integral extensions of said base extend into said perforations for securing said heating element to said base.

13. The apparatus of claim 10, wherein said base comprises a leading tip and a shovel disposed near said leading tip, said shovel having a curved bottom such that initial contact between said apparatus and the snow routinely occurs along said bottom of said shovel, said heating element comprising a curved heating plate disposed along said bottom of said shovel.

14. The apparatus of claim 10, further comprising a controller in signal communication with said heating element, for adjusting the amount of heat produced by said heating element.

15. The apparatus of claim 14, further comprising a temperature sensor capable of sensing the temperature of at least a portion of said ski, said temperature sensor being in signal communication with said controller for adjusting the amount of heat produced by said heating element in response to the temperature of said ski.

16. The apparatus of claim 15, wherein said controller is a programmed automatic controller, said programmed automatic controller programmed to signal said heating element to increase the amount of heat produced if said temperature sensor senses a temperature below a first predetermined threshold and to signal said heating element to decrease the amount of heat produced if said temperature sensor senses a temperature above a second predetermined threshold.

* * * * *